US006547198B2

(12) United States Patent
Pin

(10) Patent No.: US 6,547,198 B2
(45) Date of Patent: Apr. 15, 2003

(54) SUPPORTING DEVICE FOR A SHELF OF A PIECE OF FURNITURE OR THE LIKE

(75) Inventor: Claude Pin, Hilbesheim (FR)

(73) Assignee: Etablissements Robert Ludmann, Societe Anonyme, Niderviller (FR)

( * ) Notice: Subject to any disclaimer, the term of this patent is extended or adjusted under 35 U.S.C. 154(b) by 0 days.

(21) Appl. No.: 10/073,388

(22) Filed: Feb. 12, 2002

(65) Prior Publication Data

US 2002/0130233 A1 Sep. 19, 2002

(30) Foreign Application Priority Data

Mar. 14, 2001 (FR) ..... 01 03457

(51) Int. Cl.[7] ..... A47G 29/02; E04G 3/08; E06B 7/28

(52) U.S. Cl. ..... 248/250; 248/300

(58) Field of Search ..... 248/247, 248, 248/250, 903, 300, 235; 52/288.1; 108/108, 87, 152; 211/90.01

(56) References Cited

U.S. PATENT DOCUMENTS

| | | | | | |
|---|---|---|---|---|---|
| 3,363,867 | A | * | 1/1968 | Zackrisson | 248/250 |
| 3,493,202 | A | * | 2/1970 | Jensen | 248/538 |
| 4,037,813 | A | * | 7/1977 | Loui et al. | 248/250 |
| 4,918,893 | A | * | 4/1990 | Vandenbroucke et al. | 52/404 |
| D348,826 | S | * | 7/1994 | McCaffrey | D8/354 |
| 5,885,024 | A | * | 3/1999 | Zupan et al. | 403/389 |

* cited by examiner

*Primary Examiner*—Kimberly Wood
*Assistant Examiner*—Gwendolyn Baxter
(74) *Attorney, Agent, or Firm*—Harrison & Egbert

(57) ABSTRACT

A supporting device for a shelf of a piece of furniture or the like, including a first portion corresponding to means for fixing to said piece of furniture and a second portion defining a journal on which a shelf is capable of resting, characterized in that perpendicularly to and above said journal is provided for a sharp blocking edge. This sharp blocking edge defines an ascending angle, according to a direction from the second portion to the first portion of said device. The supporting device for a shelf is made out of a hard material, preferably of a metallic type.

5 Claims, 1 Drawing Sheet

SUPPORTING DEVICE FOR A SHELF OF A PIECE OF FURNITURE OR THE LIKE

RELATED U.S. APPLICATIONS

Not applicable.

STATEMENT REGARDING FEDERALLY SPONSORED RESEARCH OR DEVELOPMENT

Not applicable.

REFERENCE TO MICROFICHE APPENDIX

Not applicable.

FIELD OF THE INVENTION

The invention relates to a supporting device for a shelf of a piece of furniture or the like, including a first portion corresponding to means for fixing to said piece of furniture and a second portion defining a journal on which a shelf is capable of resting.

This invention will find its application in the field of the furniture industry and relates in particular to supports for shelves.

BACKGROUND OF THE INVENTION

At present, there is already known a large number of supports for shelves for furniture or the like meeting the above description. In particular, there is known a support for a shelf in the simple form of a metal rod length a portion of which is aimed at being inserted into a hole with an adapted cross-section provided for in a wall of a piece of furniture and the other portion of which, which remains protruding with respect to this wall, defines a journal on which said shelf is capable of resting.

In some cases, on this portion, which is designed so as to be capable of being protruding with respect to the wall of the piece of furniture, can be provided for a flat surface, so as to improve said shelf s capability of resting.

The portion defining the means for fixing to the piece of furniture of this supporting device for a shelf can obviously adopt other embodiments. In particular, they can be in the form of a wing extending perpendicularly to the portion acting as a support for a shelf. At the level of this wing can be provided, as the case may be, for a tip, also adapted to the cross-section of a hole provided for at the level of the wall of a piece of furniture, i.e. a hole for the passing through of a fastening screw. In fact in order to facilitate the placing of these supports for a shelf but also in order to be able to easily change their height positioning, the use of such fastening screws is usually avoided.

One clearly understands that though such devices acting as a vertical support for a shelf, they do in no way immobilize the latter as regards a horizontal displacement. Now, when a pull force is inadvertently exerted on this shelf, e.g. when a child seizes it and hangs from it, its falling down is unavoidable and, of course, also the falling down of the objects it supports. When knick-knacks or container objects are concerned, there is a possible risk for an accident.

In order to avoid such a displacement in a horizontal direction of a shelf with respect to its supports, the portion corresponding to the latter, on which said shelf rests, can, in turn, receive, as the case may be, a tip designed so as to be capable of being inserted into a perforation provided for in the lower face of said shelf or also an opening for the passing through of a fastening screw.

Here too, the placing of such a fastening screw is considered as an operation that is delicate to be carried out and/or constraining. Furthermore, the displacement in height of a shelf requires, in this case, a previous unscrewing operation, afterwards, a re-screwing operation.

As regards the solution consisting of providing a tip on the portion on which the shelf will rest the solution requires machining, at the level of the lower face of this shelf, openings for receiving these tips. Obviously, machining these openings obliges the manufacturer to re-handle the shelves after they have been cut to the desired size. In addition, these shelves are then no longer symmetrical, in that they include an upper face and a lower face that have to be taken into consideration when mounting the piece of furniture.

Finally, one should note that new applicable standards in this field require a shelf arranged at a determined height with respect to the floor to be fixed, in all cases, in order to avoid a horizontal displacement, when a normal pulling force is applied onto it. Therefore, only the most constraining solutions set forth above are presently applicable to comply with such standards.

BRIEF SUMMARY OF THE INVENTION

This invention is aimed at being capable of coping with the above-mentioned constraints with a simple solution that requires no specific arrangement or machining at the level of the shelves, while avoiding using fastening organs, such as screws or the like.

To this end, the invention relates to a supporting device for a shelf of a piece of furniture or the like, including a first portion corresponding to means for fixing to said piece of furniture and a second portion defining a journal on which a shelf is capable of resting, characterized in that perpendicularly to and above said journal is provided for a sharp blocking edge.

Advantageously, this sharp blocking edge defines an ascending angle, according to a direction from the second portion to the first portion of said device.

Furthermore, according to the invention, the supporting device for a shelf is made out of a hard material, preferably of a metallic type.

Finally, the advantages that result from this invention reside in that under the influence of the presence of the sharp blocking edge, the shelf is anchored, in a natural way and almost under its own weight, onto the supporting device, so that it is fixed, avoiding an unwanted horizontal displacement.

DETAILED DESCRIPTION OF THE INVENTION

As can be seen in the figures of the attached drawings, this invention relates to a supporting device 1 for a shelf of a piece of furniture or the like.

Figure 1:
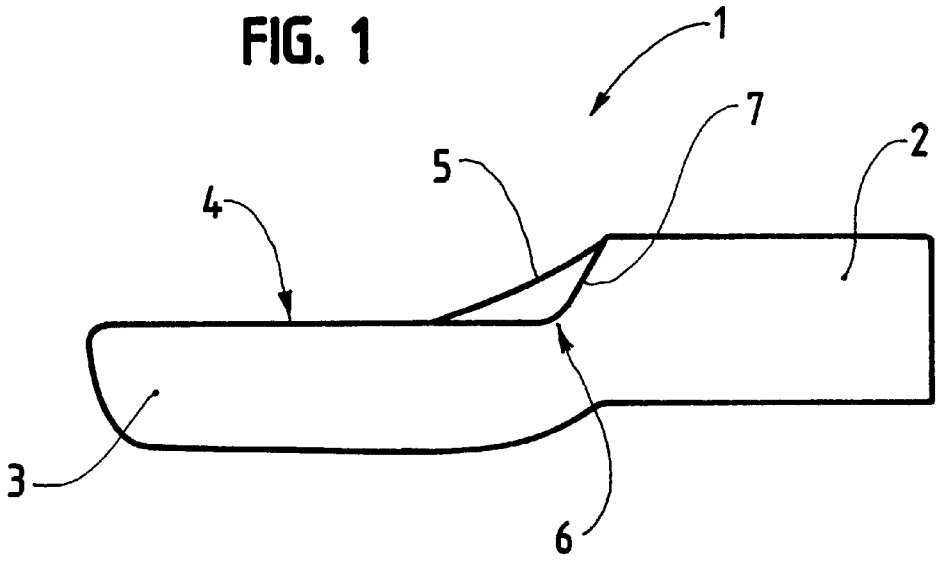
FIG. 1 is a schematic and elevation view of a support for a shelf according to the invention.
Figure 2:
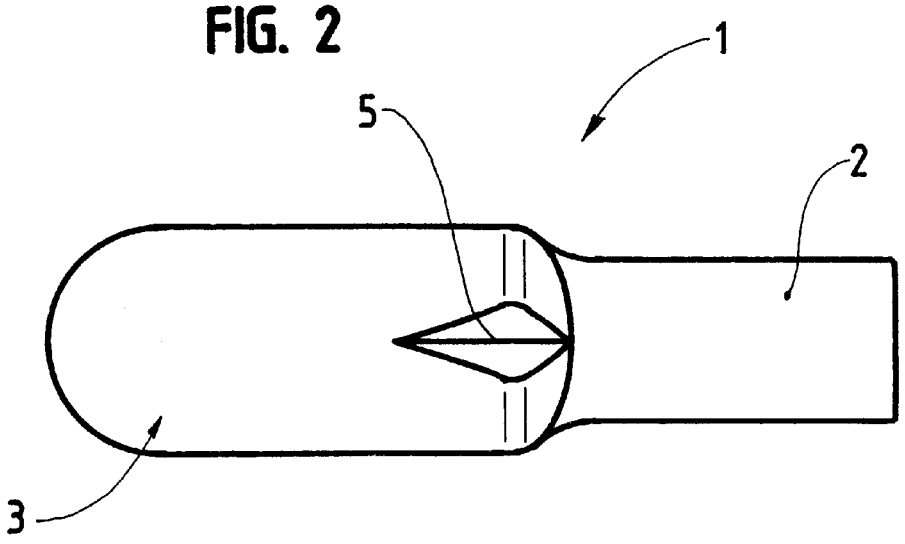
FIG. 2 is a schematic and plan view of the support for a shelf shown in FIG. 1.

Thus, such a device 1 includes a first portion 2 that can adopt various embodiments and that corresponds to fastening means through which it is capable of being made integral with a wall of a piece of furniture. Thus, as can be seen in these FIGS. 1 and 2, this first portion 2 of the supporting device 1 can simply adopt the form of a cylindrical tip designed so as to be capable of being inserted into a hole with an adapted cross-section provided for, as a matter of fact, in a wall of a piece of furniture.

This supporting device 1 also includes a second portion 3 defining, in turn, a journal on which said shelf is capable of resting.

In particular, according to a exemplary embodiment at the level of this journal, defined by this second portion 3 of the supporting device 1, can be provided for a flat surface 4 usually aimed at improving the resting of said shelf.

In fact, according to the invention, above and perpendicularly to the journal, defined by the portion 3 of the supporting device 1, extends a sharp blocking edge 5.

Advantageously, the latter has a pyramidal cross-section and is ascending according to a direction from the second portion 3 towards the first portion 2 of the supporting device 1.

In particular, using sharp blocking edge is located in the corner 6 defined by the flat surface 4 and a shoulder 7 substantially delimiting the first portion 2 with respect to the second portion 3 of this supporting device 1.

Preferably, such a supporting device 1, at least the sharp blocking edge 5, is made out of a hard material, namely of metal or a rigid synthetic material.

Thus, through a slight pressure exerted on the shelf, even under its own weight, the latter is anchored onto said sharp blocking edge 5 of the supporting devices 1, so that it is immobilized, avoiding a horizontal displacement. In particular, this immobilization in translation of the shelf by means of supporting devices 1 according to the invention is capable of complying with the standards applicable in this field.

As results from the preceding description, the design of the supporting device for a shelf 1 according to the invention avoids any specific machining of said shelf which keeps its reversibility.

I claim:

1. A supporting device for a shelf for a piece of furniture comprising:

a first portion having means for attachment without fasteners to the piece of furniture, said first portion having an upper surface; and a second portion extending outwardly from said first portion and having an upper surface means for resting the shelf thereon, said upper surface means of second portion having a sharp blocking edge ascending to said upper surface of said first portion, said upper surface of said first portion being positioned at a level higher than a level of said upper surface means of said second portion, said first portion being integrally formed with said second portion.

2. The device of claim 1, said sharp blocking edge having pyramidal cross-section.

3. The device of claim 1, said sharp blocking edge extending upwardly from said upper surface means of said second portion, said upper surface means being a flat surface, said first portion and said second portion defining a first shoulder extending therebetween on one side of said sharp blocking edge and a second shoulder extending therebetween on an opposite side of said sharp blocking edge.

4. The device of claim 1, said sharp blocking edge being of a rigid material.

5. The device of claim 1, and said first portion and said second portion being of a rigid material.

* * * * *